United States Patent [19]

Figueroa

[11] Patent Number: 4,538,816

[45] Date of Patent: Sep. 3, 1985

[54] COMMODITIES TRADING GAMES OF SKILL AND CHANCE

[76] Inventor: Carlos A. Figueroa, 41 Townsend Ave., Staten Island, N.Y. 10314

[21] Appl. No.: 542,418

[22] Filed: Oct. 17, 1983

[51] Int. Cl.[3] ..... A63F 3/00

[52] U.S. Cl. ..... 273/256

[58] Field of Search ..... 273/256, 278

[56] References Cited

U.S. PATENT DOCUMENTS

| | | | |
|---|---|---|---|
| 2,026,082 | 12/1935 | Darrow | 273/256 |
| 2,666,644 | 1/1954 | Strehlow et al. | 273/256 |
| 2,976,044 | 3/1961 | Corpening | 273/256 |
| 3,163,423 | 12/1964 | Jackson | 273/256 |
| 4,445,692 | 5/1984 | Boyle | 273/256 |

FOREIGN PATENT DOCUMENTS

| | | | |
|---|---|---|---|
| 1587415 | 4/1981 | United Kingdom | 273/256 |
| 2078118 | 1/1982 | United Kingdom | 273/256 |

*Primary Examiner*—Richard C. Pinkham

*Assistant Examiner*—Scott L. Brown

*Attorney, Agent, or Firm*—Richard L. Miller

[57] ABSTRACT

A board game apparatus for a commodities trading game which is played by a number of players, each having his own playing piece which traverses a playing board having a number of defined sequential spaces constituting a playing path. A majority of the spaces are uniquely identified so that each respectively represents the trade of a particular commodity. A set of commodity cards are provided with each card corresponding to a particular one of the commodity spaces. Other spaces have a common identification as a fact select space. A set of fact cards has each a card identified with a different investment face situation. Play money for distribution to the players and chance determining means are included. The players can trade in the commodities by buying and selling future contracts of the commodities, options, as well as the actual commodities, in order to increase their initial distribution of the play money to achieve the greatest profit.

13 Claims, 2 Drawing Figures

COMMODITIES TRADING GAMES OF SKILL AND CHANCE

BACKGROUND OF THE INVENTION

This invention relates to a board game, and more particularly to a board game involving the trading of commodities, including the buying and selling of futures contracts, options, as well as the actual commodities, whereby an individual can enjoy a game and learn about commodities trading.

Many board games are presently available for enjoyment which require a degree of skill combined with a risk of chance. In order to make these type of board games more interesting, they are often designed after real life circumstances. Accordingly, while the game may involve chance determining means, or selection means, it also requires a degree of skill on behalf of the player, to cope with the simulated circumstances.

With these board games, the player not only develops a greater skill in playing the game, but also develops a greater education about the particular real life circumstances presented by the board game. The more complex the situation, the greater the challenge in the game and at the same time the more the player can learn about the particular real life challenge which serves as the theme of the game.

Although board games have been based on sport themes, wars, real estate situations, and other social and economic conditions, one theme which has thus far not been addressed by a board game relates to the trading of commodities. In real life, commodities trading involves a great degree of risk, but also has great rewards in terms of profitability for the successful individual. The variations involved in the commodities trading are such that an individual has many choices and in order to become skillful in this area requires much training. As a result, commodities trading is a most challenging theme which requires a great degree of skill in order to be successful.

SUMMARY OF THE INVENTION

Accordingly, an object of the present invention is to provide a board game apparatus based upon a theme of commodities trading.

Another object of the present invention is to provide a board game permitting the use of skill in gaining knowledge about commodities trading and combining such skill with a degree of chance so as to provide interest to the game.

A further object of the present invention is to provide a board game based upon commodities trading which can develop a sense of skill in connection with this area to all players involved in the game.

Yet another object of the present invention is to provide a board game apparatus based upon a commodities trading theme, including a playing board around which there is defined a playing path, with the particular spaces on the playing board identifying particular transactions of the commodities trading.

Briefly, in accordance with the present invention, there is provided a game board apparatus for commodities trading game to be played by a plurality of players. A plurality of playing pieces are provided, so that each player will have his own piece. A playing board is included which has a plurality of defined sequential spaces constituting a playing path about the outer margin of the board. The playing path is to be traversed by the playing pieces during the playing of the game. Appropriate identification is provided to a majority of the sequential spaces which uniquely identifies each of the spaces, respectively, with a particular type of commodity. These spaces are referred to as commodity spaces. A set of commodity cards are also provided, each card being uniquely identified so as to correspond with a respective one of the commodity spaces. The corresponding one of these cards is presented to the player who transacts the particular commodity trade referred to on the commodity space on which his playing piece lands. There are an equal number of commodity cards and commodity spaces.

Other of the sequential spaces are identified by an identical card indicator. These other spaces are referred to as fact spaces. A set of fact cards is provided for selecting by chance. Each of the cards are uniquely identified with a different commodity investment fact situation. Each player can draw one of these cards when his playing piece lands on a particular fact space.

Chance determining means are included for indicating the number of sequential spaces in the playing to be traversed by the player's playing piece in one turn. Play money is provided for distribution to the players. Each player can trade in commodities during the course of the game by buying and selling future contracts in commodities, options, or the actual commodities, in order to increase his initial distribution of playing money to achieve a greater profit.

The invention further includes a set of speculate cards which are chance selected. Each card being uniquely identified with an increase or decrease in the commodity indicator value scale. Each player can optionally draw one of the speculate cards when his playing piece lands on a commodity space and the player is not going to transact the particular commodity trade referred to on that commodity space.

The aforementioned objects, features and advantages of the invention will, in part, be pointed out with particularity and will, in part, become obvious from the following more detailed description of the invention, taken in conjunction with the accompanying drawings, which forms and integral part thereof.

BRIEF DESCRIPTION OF THE DRAWINGS

In the various figures of the drawings, like reference characters denote like parts.

DESCRIPTION OF THE PREFERRED EMBODIMENT

Figure 1:
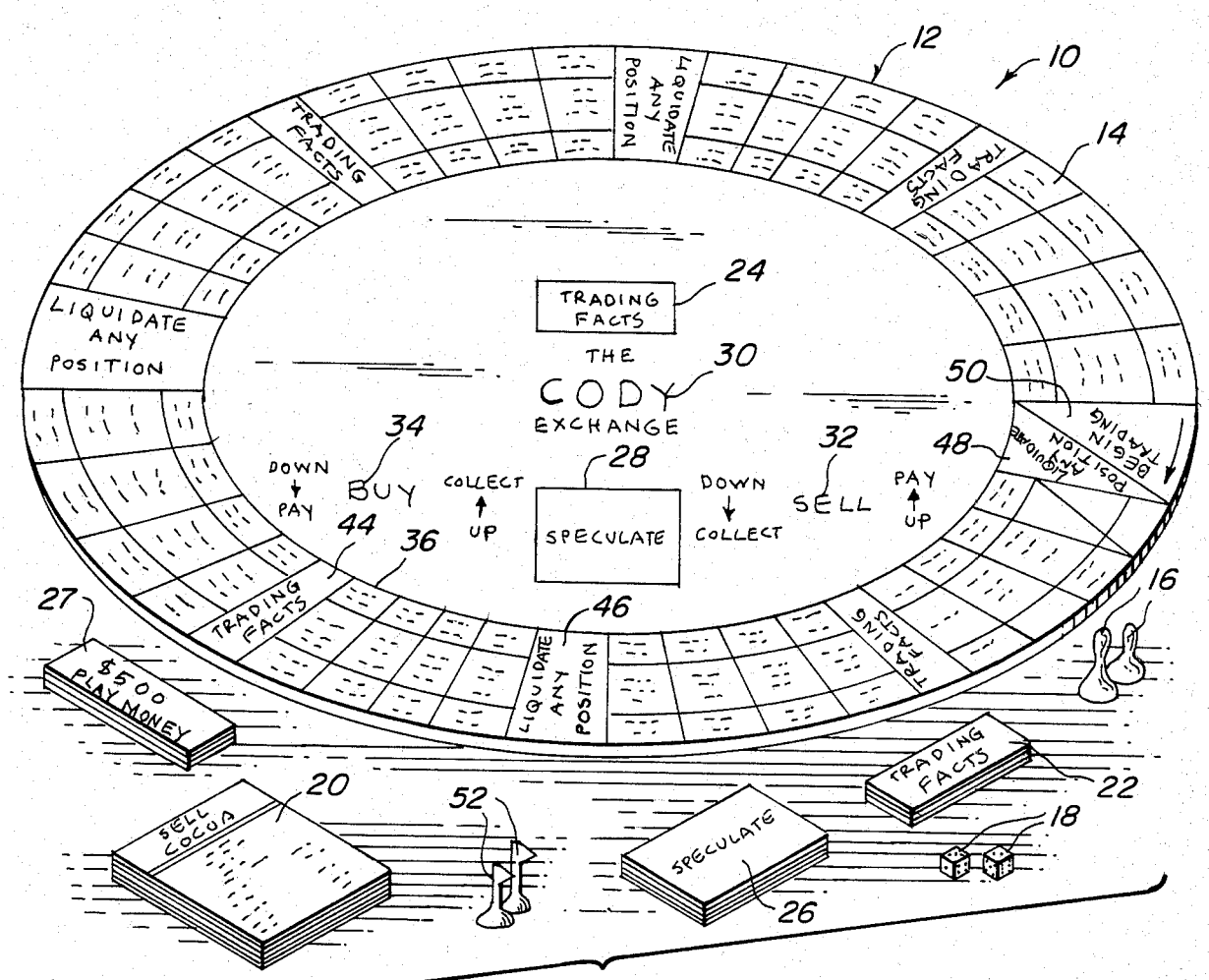
FIG. 1 is a perspective view of the various components forming the game apparatus of the present invention.
Figure 2:
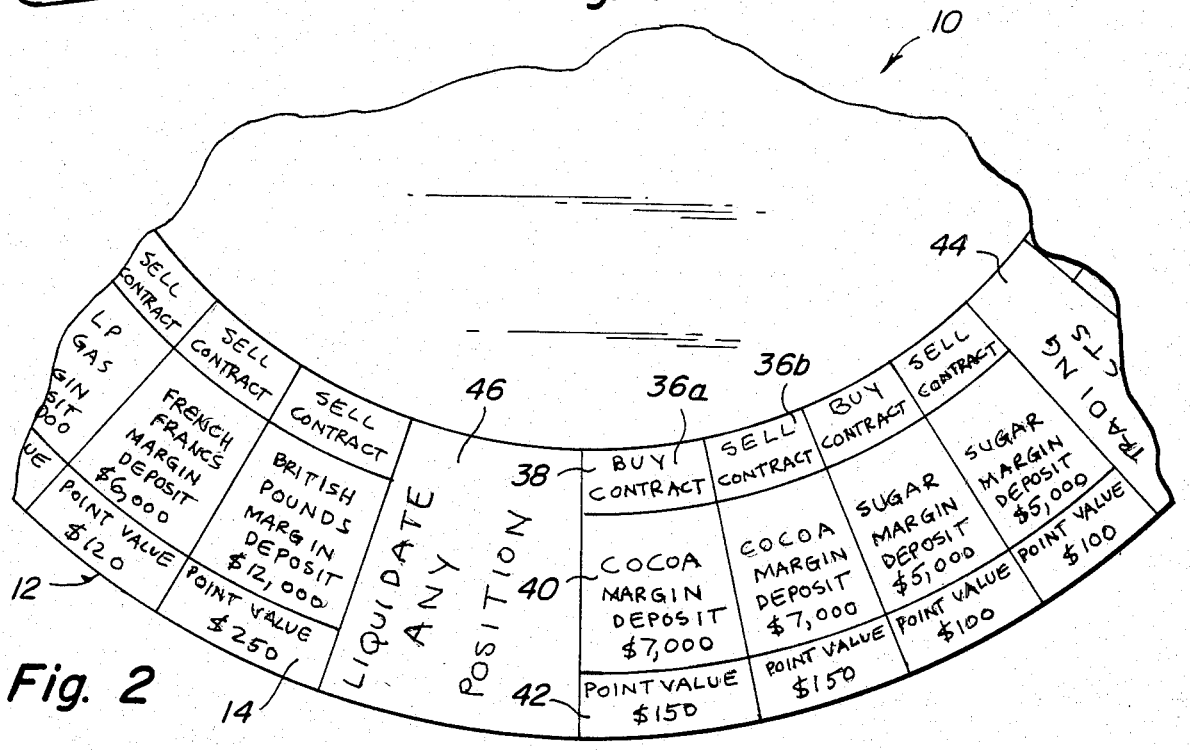
FIG. 2 is an enlarged partial sectional view of the game show in plain view.

Referring now to FIGS. 1 and 2, the board game apparatus of the present invention comprises a playing board, shown generally at 10, and being of circular construction. A playing path 12 is defined along the outer periphery thereof and is divided into a plurality of sequential spaces 14. A plurality of individual playing pieces 16 are included, with one playing piece being provided for each player. The playing pieces traverse the path of the game.

A set of dice 18 constituting the chance determining means, are included for indicating the number of sequential spaces of the playing path which are to be transversed by each of the playing pieces during one turn.

Three sets of cards are included. The first set of cards, 20, are referred to as commodity cards, and include means identifying each card, respectively, with a corresponding commodity playing space along the playing path. A second set of cards 22, referred to as trading fact cards, serve as chance selection cards. These cards are placed on an identifying position location 24 provided near the center of the game board.

A third set of cards, 26, serving as speculate cards, are also chance selection cards. These are also placed in the indicated location 28 provided near the center of the game board. The game board also includes specific indicia 30 identifying the name of the game as "The Cody Exchange" referring to the real life commodity exchange. Since the commodity trading pit of this exchange is round, the game board is also made round.

On either side of the speculate space 28 there are provided reminder indicators for particular transactions. Specifically, on the right side the indicia 32 indicates that in a sell situation, if the market goes up, the individual must pay, while if the market goes down the individual collects. On the left side there is a corresponding reminder 34 for a buy situation. In this case, if the market goes up, the player collects, while if the market goes down, the player must pay. Play money 27 is included for distribution to the players.

As best seen in FIG. 2, a majority of the sequential spaces are defined as commodity spaces 36. The commodity spaces can either be of the buy type 36A, or the sell type as at 36B. In each commodity space, the upper section 38 is used to identify the particular type of contract, namely whether it is a buy or sell contract. The center part of the commodity space 40 is used to identify the particular commodity involved, such as cocoa, sugar, foreign currencies, etc. It also indicates how much margin deposit must be placed with the exchange in order to secure the particular contract. In the lower part 42 of the commodity space, there is also included the dollar amount for each point value. Accordingly, should the market go up by 10 points, there would have to be exchanges 10 times the particular point value indicated on the commodity space.

As is noted in FIGS. 1 and 2, the playing path is organized so that there are four sequential commodity squares 36 located in a particular group. Groups are then separated, alternately, by either a "trading fact" space 44, or a "liquidate any position space" 46.

One of the particular "liquidate any position" spaces 48 also includes the information "begin trading" in the bottom half of that space 50. It is at this point that the playing pieces 16 are initially positioned in order to begin the game.

In one particular group of the four commodity spaces, one of the commodity spaces are replaced with a space indicating "suspended from trading". At another one of the commodity spaces in one of the groups, the commodity space is replaced by a "delivery" space which is provided for both making delivery and taking delivery of the commodity.

As noted in FIG. 1, there are 8 groups of four commodity spaces. Accordingly there are a total of 32 commodity spaces. However, as previously indicated, two of these are replaced by the "suspended from trading" space and the "delivery" space. Accordingly, there are a total of 30 individual commodity spaces. Fifteen of these relate to buy contracts and fifteen relate to sell contracts. As previously indicated, there is provided a single one of the commodity cards 20 for each corresponding commodity space 36. Accordingly, there are provided 15 buy contract cards, and 15 sell contract cards.

On one side of each of the commodity cards, both the buy and sell type, there is provided an identification of the particular trading transaction, specifically whether it is a buy or sell contract. There is also identified the particular type of commodity involved. On the same side there is also an indication of the total cost of the contract, the margin deposit required for the contract, and the point value of the contract. To facilitate calculation, there is also provided an indication of how much the point value would be for 1 point, 10 points, 20 and 50 points of a change in the market.

On the back of each sell contract there is no specific information provided, and any desired indication can be included. However, on the back of the buy cards, there is an actual indication of the physical price list of the various commodities involved. For example, in connection with the commodities, there is provided a warehouse receipt for the items physically included in the warehouse of this particular commodity.

The speculate cards all include a specific identification indicia on one side thereof to indicate that they are speculate cards. On the other side, each individual card indicates a different value of points that the market can go up or down. For example, one card may indicate "up 10 points" while another card may indicate "down 15 points" etc. In addition to particular transaction fact situations, some of these cards can also indicate game instructions, such as "go back three spaces" etc.

On the front side of these cards, there is indicated a common designation, such as "trading facts".

In this manner, both the speculate and trading facts cards are placed face down on their appropriate locations on the board so that the players are unaware of the particular information contained on the cards until the card is drawn at the appropriate time in the game.

In addition to the foregoing, the game can include position flags 52 corresponding in color and number to the playing pieces 16. The colored flags are used to place onto the commodities space for commodities that have been purchased, in accordance with the playing procedures.

In order to more fully comprehend the present game, the following are the suggested rules of play for the game.

OBJECT OF THE GAME

The object of the game is to become the most profitable player with your initial investment by buying and selling futures contracts, options, and physical commodities.

MATERIAL REQUIRED FOR PLAY

One Cody Board
Cody Money
Fifteen Buy Contracts
Fifteen Sell Contracts
Four Sets of Colored Flags
Four Position Pieces, Same Color as Flags
One Set of Dice
Thirty Speculate Cards
Fourteen Trading Fact Cards

PREPARATION FOR PLAY

Each player must choose a position man, if the Exchange is also a player the player must separate all his money and commodities from that of the Exchange.

Each player will receive $100,000 as follows:

One $50,000
One $10,000
Five $5,000
Twelve $1,000
Four $500
Six $100
Six $50
Five $20

With the exception of the above, the Exchange owns all contracts, commodities and cash.

TRADING RULES

1. Each player shall throw the dice; the player with the highest number shall begin trading.

2. A player landing on a "Buy or Sell" contract not owned by another player must:

(a) Day Trade: by picking the speculate card (see Rule 3) or, (b) Buy the contract from the Exchange by paying the margin deposit amount shown on the face of the contract on the board, or (c) Give up his privilege of either of the above by paying to the Exchange 10 times the point value of that futures contract shown on the board.

3. DAY TRADE: If the player is on the buy contract when he chooses to day trade and the speculate card reads down, he must pay the owner of the contract or the Exchange. If the card reads up, he shall collect from the owner of the contract or the Exchange. If the player is on the sell contract and the speculate card reads down, he shall collect. If the card reads up, he must pay (as shown on the face of the board).

4. The face of each contract shows the value of each point the player is to pay or collect.

5. If a player lands on a futures contract, (BUY or SELL) owned by another player, he must (a) "Day Trade" with that player, (See Rule 3) or (b) Buy the contract from that player, or (c) Give up his privilege of either of the above by offering to pay to that player a cash sum not less that 10 times the point value (note: either player can offer to pay-off the other rather than "Day Trade").

6. If a player lands on a "buy" contract he already owns, he can "take delivery" of the physical commodity represented by that Contract. To take delivery the player must pay the Exchange the cost of the commodity shown on the face of the contract less the margin deposit already paid. Once delivery is taken, that futures contract expires and the player must turn the contract over, displaying the warehouse receipt (indicating ownership of the physical commodity) and places his individual colored marker (flag) above the commodity on the board.

7. Players cannot take delivery with a sell contract.

8. If a player lands on a commodity where another player owns the physical commodity, he must roll the dice and pay the owner of the physical commodity the amount shown on the warehouse receipt.

9. Players can sell their physical commodity back to the Exchange (make delivery) at cost, or to the highest bidder, whenever the player owning the physical commodity lands on the sell contract of that commodity. However, if the player does not own the sell contract, he must pay the owner of the sell contract 10 points and drawing the speculate card would not be required. (Note: Players who sell their physical commodity must remove the colored marker (Flag) from the board and return the warehouse receipt to the Exchange.)

10. If a player is ever forced to sell his physical commodity without landing on the sell contract, he must still pay the owner of the sell contract the 10 points.

11. Any player who has landed on a "buy" contract where another player owns the physical must, after paying the player, "day trade" on that same "buy" contract just like any other futures contract.

12. "OPTIONS TRADING"

BUYING AN OPTION

Any player landing on a Commodity where the physical is owned may ask, or may be asked by the owner of the Commodity, if he would like to buy an option instead of "day trading". To trade an option, the player landing on the Commodity where the option will be traded must first pay the owner of the Commodity a "premium" (a cash sum) of twenty (20 points), then pick a speculate card. If the card reads "down" the buyer of the option does not have to pay the other player, no matter how many points the card is down. If the card reads "up" the buyer of the option shall collect from the seller of the option the full amount of points the card reads "up".

EXERCISING AN OPTION

Any player who has purchased an option which gained 20 points or more, after collecting from the seller, has the right to buy the physical commodity from the seller by paying the seller the cost price of the commodity.

13. "EXCHANGE TRADE"

Players can convert their "physical commodity" back to a futures contract and collect from the Exchange the difference between the cost of the physical and the Margin Deposit wherever they land on their own physical commodity. Once doing so, the player must remove the flag from the board and turn the contract over, indicating he owns the futures contract and not the physical commodity.

14. The game is played in sessions. The session ends when all the speculate cards are drawn. Each game must be at least one session long and as many sessions as agreed to by all players.

TRADING FACTS

Players landing on this square must pick a card and follow the stated instructions.

The Trading Fact Card "Stop Loss"

Players drawing these cards can retain them for the entire session.

Players can use this card to limit their loss to the stated amount on the card whenever they "day trade" with another player or the Exchange.

The Trading Fact Card "Squeeze Play"

Players holding this card can prevent another player from taking delivery of any commodity. The card can be held throughout the entire session. Once used it must be returned to the pile.

The Trading Fact Card "SUSPENDED FROM TRADING"

Players drawing this card must move their piece to the square Suspended from Trading, and lose one turn.

LIQUIDATE ANY POSITION

Players landing on this square who hold a "buy or sell" contract can sell back any one of their contracts to the Exchange. If players do not wish to sell this square would serve as a rest stop.

TAKE-DELIVERY-MAKE

Players landing on this square who own any "buy" contract can take immediate delivery of the physical commodity. (See rule 6 on How to Take Delivery.) Players owning a physical commodity can make immediate delivery (sell back the physical commodity the the Exchange at cost), without having to land on the sell contract. (See rule 9 on How to Make Delivery.) (Note: Players making delivery when landing on this square do not pay the ten(10) points to the owner of the sell contract.)

There has been disclosed heretofore, the best embodiment of the present invention. However, it is to be understood that various changes and modifications may be made thereto without departing from the spirit of the invention.

What is claimed is:

1. A board game apparatus for a commodities trading game to be played by a plurality of players, comprising:

a plurality of playing pieces-one for each player;

a playing board having a plurality of defined sequential spaces constituting a playing path about the outer margin of said board, to be traversed by said pieces during the playing of the game;

means associated with the majority of said sequential spaces uniquely identifying each, respectively, with the trade of a commodity, said spaces being referred to as commodity spaces;

a set of commodity cards, each uniquely identified to correspond with a respective one of said commodity spaces for presentation to a player transacting the trade of a commodity referred to on the commodity space on which a playing piece lands, there being an equal number of commodity cards, and commodity spaces;

a commodity market value associated with each of said commodity cards;

first and second means associated with said commodity spaces to divide said commodity spaces into respectively two different classes of commodity spaces, said two classes of commodity spaces being interposed with each other about the playing path, corresponding first and second other means associated with said commodity cards correspondingly dividing said commodity cards into two corresponding classes of cards, there being an equal number of spaces of each class;

means associated with other of said sequential spaces identifying them with an identical chance card indicator, such spaces being referred to as fact spaces;

a set of chance selection fact cards, each uniquely identified with a commodity investment fact situation, each player drawing one of said fact cards, when its playing piece lands on a fact space;

chance determining means for indicating a number of said sequential spaces in said playing path to be traversed by that player's playing piece in one turn;

play money for distribution to the players, whereby each player can trade in commodities by buying and selling future contracts of the commodities, options, and the actual commodities, in order to increase his initial distribution of playing money to achieve the greatest profit, and further comprising a set of chance selection speculate cards, each containing indicia an increase or decrease in the commodity market value each player optionally drawing one of said speculate cards when his playing piece lands on a commodity space and the player is not transacting the trade referred to on that commodity space.

2. A board game apparatus as in claim 1, and further comprising means associated with yet another of said sequential spaces, identifying them with an identical financial position rearranging indicator, such spaces being referred to as liquidate spaces.

3. A board game apparatus as in claim 2, wherein said playing path comprises groups of four sequential commodity spaces, each such group being alternately separated from a subsequent group by one of said fact spaces and said liquidate spaces, each of said groups comprising at least one commodity spaces of each of said two classes of commodity spaces.

4. A board game apparatus as in claim 3, wherein at least one group comprises a single commodity space having means associated with such single space identifying that space as a make and take delivery space.

5. A board game apparatus as in claim 3, wherein at least one group has one of its commodity spaces comprising, means associated with said one commodity space for identifying that space as a suspension from trading place.

6. A board game apparatus as in claim 2, wherein said playing board is round, and said playing path is formed about the outer periphery of the playing board.

7. A board game apparatus as in claim 6, and comprising means associated with the inner portion of the playing board bounded by said playing path for defining the placement of said set of fact cards and the placement of said speculate cards.

8. A board game apparatus as in claim 1, wherein some of said fact cards are identified with game movement instructions.

9. A board game apparatus as in claim 1 wherein said first and second other means identify a commodity, the trade of the commodity as a buy or sell, the margin deposit required, and the point value of the commodity contract.

10. A board game apparatus as in claim 9, wherein said first and second other means identify some of said commodity cards as buy cards and some as sell cards, each of said commodity cards having on one side thereof means identifying the commodity, the trade of the commodity as a buy or sell, the margin deposit required, the point value of the contract, and an indication of the values corresponding to each of the increases and decreases in the commodity market value, as contained on said speculate cards.

11. A board game apparatus as in claim 10, wherein each of said buy cards have on one side thereof, means identifying the price list of the physical commodity involved.

12. A board game apparatus as in claim 1, and further comprising a plurality of flags, one for each player.

13. A board game apparatus as in claim 12, wherein said plurality of playing pieces and said plurality of flags are correspondingly identified.

* * * * *